US008281623B2

(12) United States Patent
Lim et al.

(10) Patent No.: US 8,281,623 B2
(45) Date of Patent: Oct. 9, 2012

(54) TOP-LOADING DRUM TYPE WASHING MACHINE

(75) Inventors: Hee Tae Lim, Kyungki-do (KR); Jae Won Chang, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 463 days.

(21) Appl. No.: 12/064,247

(22) PCT Filed: Mar. 16, 2006

(86) PCT No.: PCT/KR2006/000950

§ 371 (c)(1),
(2), (4) Date: Jul. 25, 2008

(87) PCT Pub. No.: WO2007/105843

PCT Pub. Date: Sep. 20, 2007

(65) Prior Publication Data

US 2009/0000340 A1 Jan. 1, 2009

(51) Int. Cl.
*D06F 21/00* (2006.01)
*D06F 23/00* (2006.01)

(52) U.S. Cl. ..... 68/142; 68/3 R; 68/143

(58) Field of Classification Search ..... None
See application file for complete search history.

(56) References Cited

U.S. PATENT DOCUMENTS 5,768,730 A * 6/1998 Matsumoto et al. ..... 8/159
5,813,253 A 9/1998 Uhlin
6,578,391 B2 * 6/2003 Seagar et al. ..... 68/142
6,782,722 B2 * 8/2004 Yokoi et al. ..... 68/12.06
2003/0056555 A1 3/2003 Yokoi et al.
2003/0061841 A1 4/2003 Nakamura et al.
2004/0129035 A1 * 7/2004 Chang ..... 68/23 R
2005/0016225 A1 * 1/2005 Poehler ..... 68/12.02
2006/0016228 A1 * 1/2006 Chang et al. ..... 68/23.1
2006/0150688 A1 7/2006 Kim et al.
2006/0169006 A1 8/2006 Lim et al.
2006/0179584 A1 8/2006 Choi et al.

(Continued)

FOREIGN PATENT DOCUMENTS

DE 2113655 A1 9/1972

(Continued)

OTHER PUBLICATIONS

Jang, Jae-won,Jan. 2005, KR 10-2002-0085521, English machine translation.*

(Continued)

*Primary Examiner* — Michael Barr
*Assistant Examiner* — Jason Ko
(74) *Attorney, Agent, or Firm* — KED & Associates, LLP

(57) ABSTRACT

A top loading drum type washing machine is provided. The washing machine may include a cabinet, a tub installed in the cabinet, and a drum rotatably installed in the tub. Openings respectively provided in the cabinet, the tub and the drum may be aligned to allow laundry items to be loaded into and removed from the drum. A door may be provided at the opening formed in the drum to open and close the opening. At least one side assembly may be provided an axial end of the drum to support rotation of the drum by a motor. A buffer may be connected between the at least one side assembly and the tub, and a suspension may be connected between the at least one side assembly and the cabined to absorb and damp vibration.

17 Claims, 5 Drawing Sheets

U.S. PATENT DOCUMENTS

| | | | | |
|---|---|---|---|---|
| 2006/0243003 | A1* | 11/2006 | Chang | 68/3 R |
| 2007/0017261 | A1 | 1/2007 | Chang et al. | |
| 2007/0089245 | A1 | 4/2007 | Kim et al. | |

FOREIGN PATENT DOCUMENTS

| | | | |
|---|---|---|---|
| EP | 1295978 | A1 | 3/2003 |
| EP | 1433891 | A2 | 6/2004 |
| JP | 2003-93790 | | 4/2003 |
| JP | 2003-103095 | | 4/2003 |
| JP | 2004-188172 | | 7/2004 |
| KR | 1020020085521 | B1 * | 1/2005 |
| KR | 10-2006-0042684 | | 5/2006 |

OTHER PUBLICATIONS

English language Abstract of JP 2003-93790.
English language Abstract of JP 2004-188172.
English language Abstract of JP 2003-103095.
English language Abstract of KR 10-2006-0042684.

* cited by examiner

[Fig. 1]
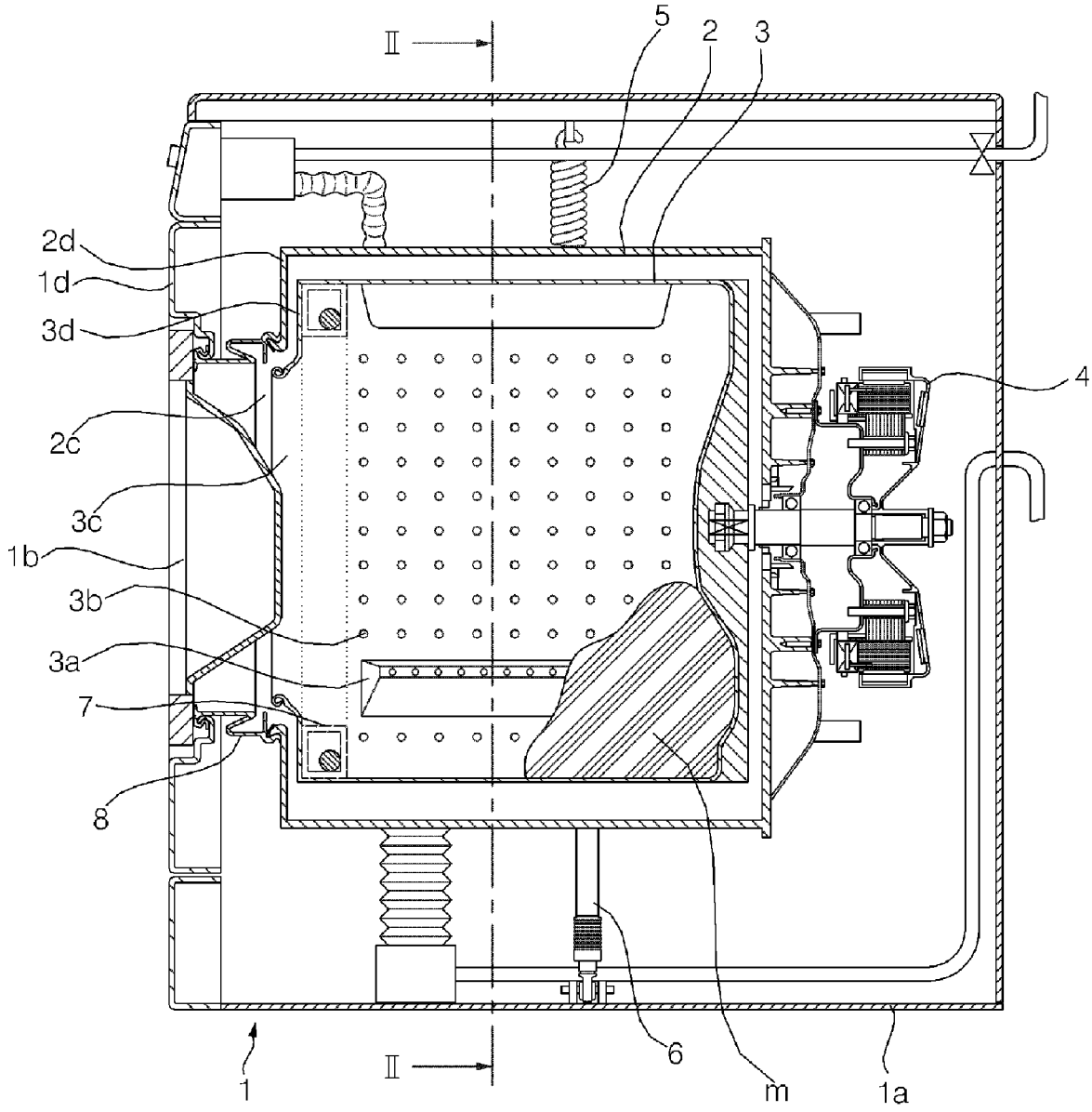

[Fig. 2]
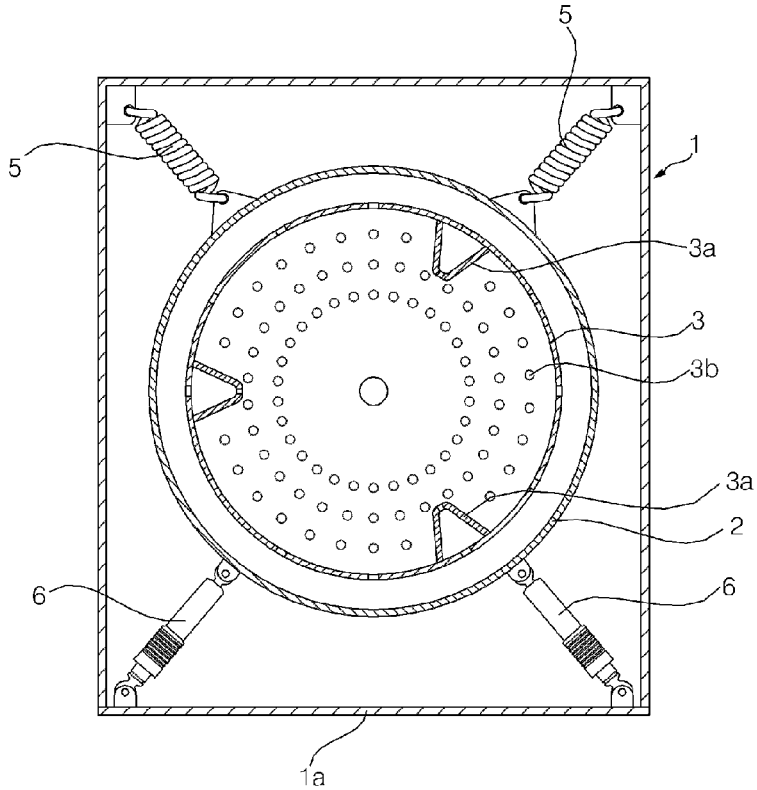
[Fig. 3]
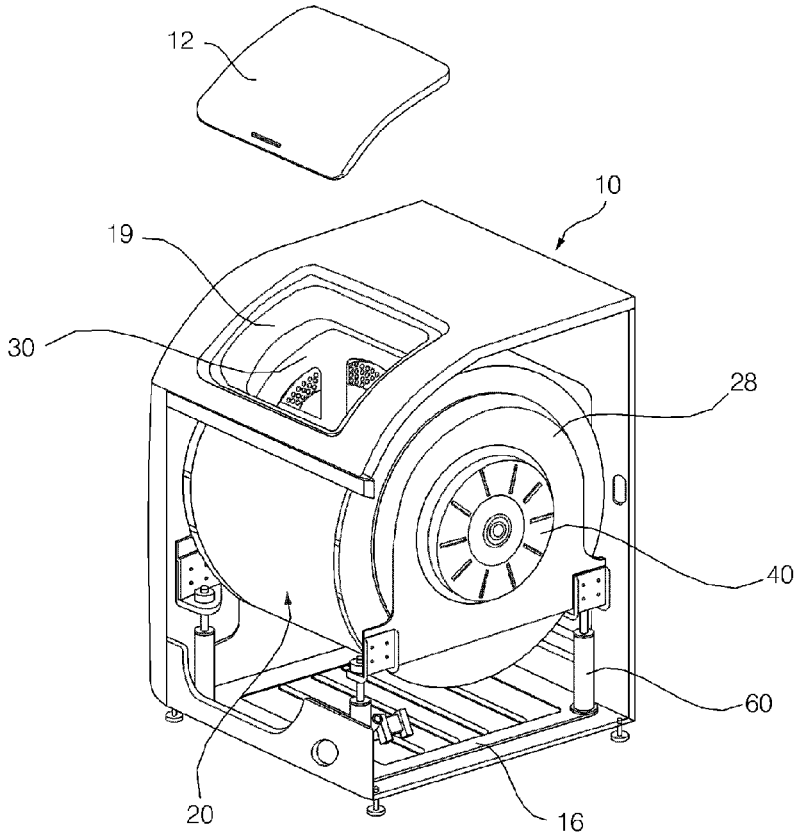

[Fig. 4]
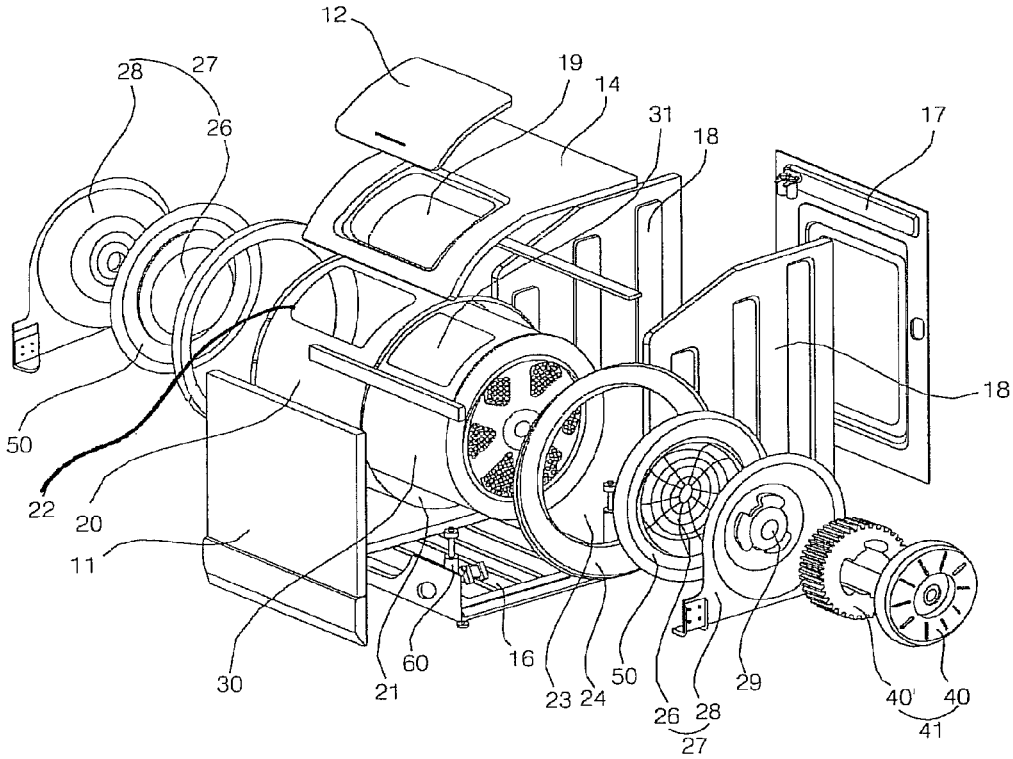

[Fig. 5]
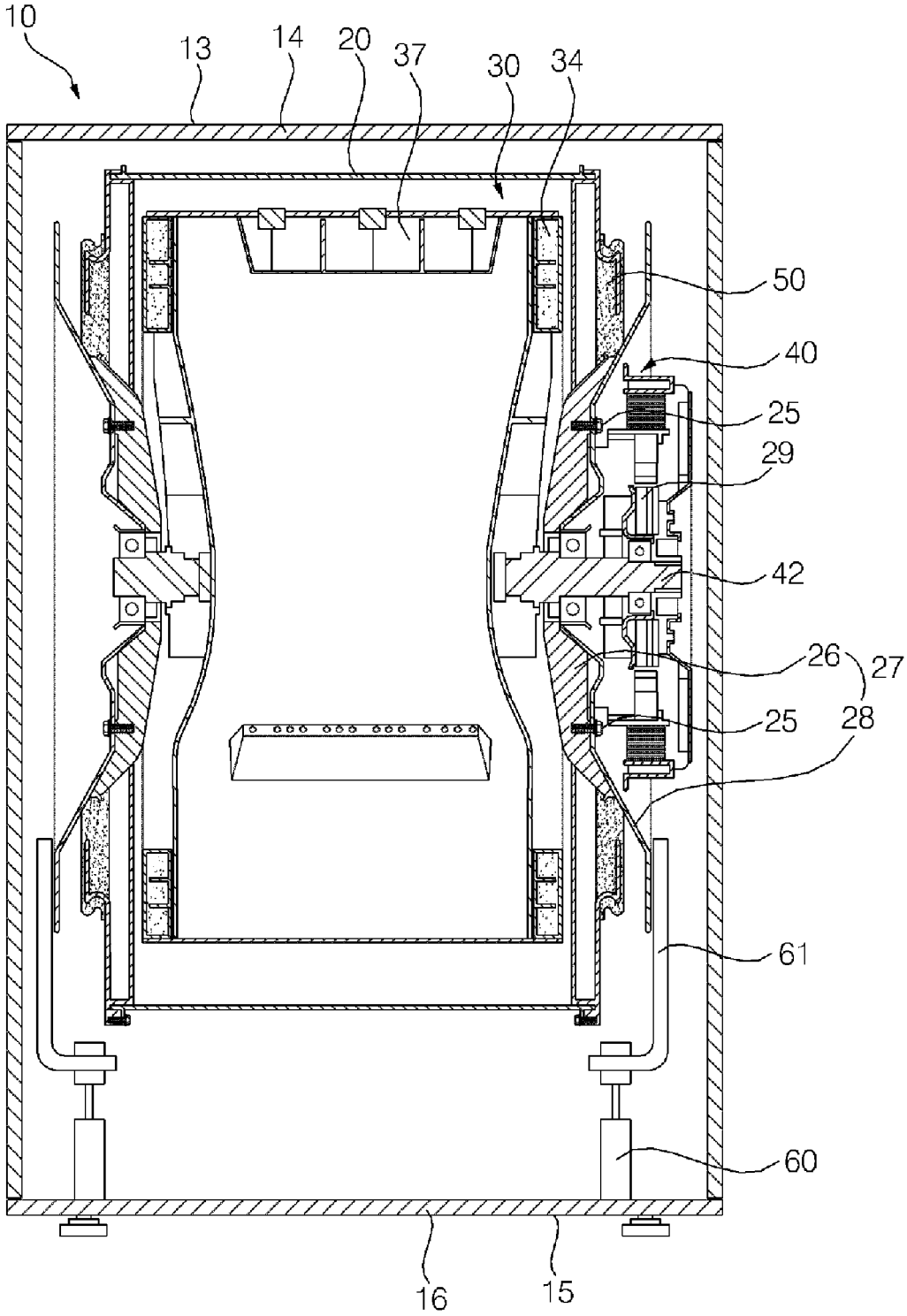

[Fig. 6]
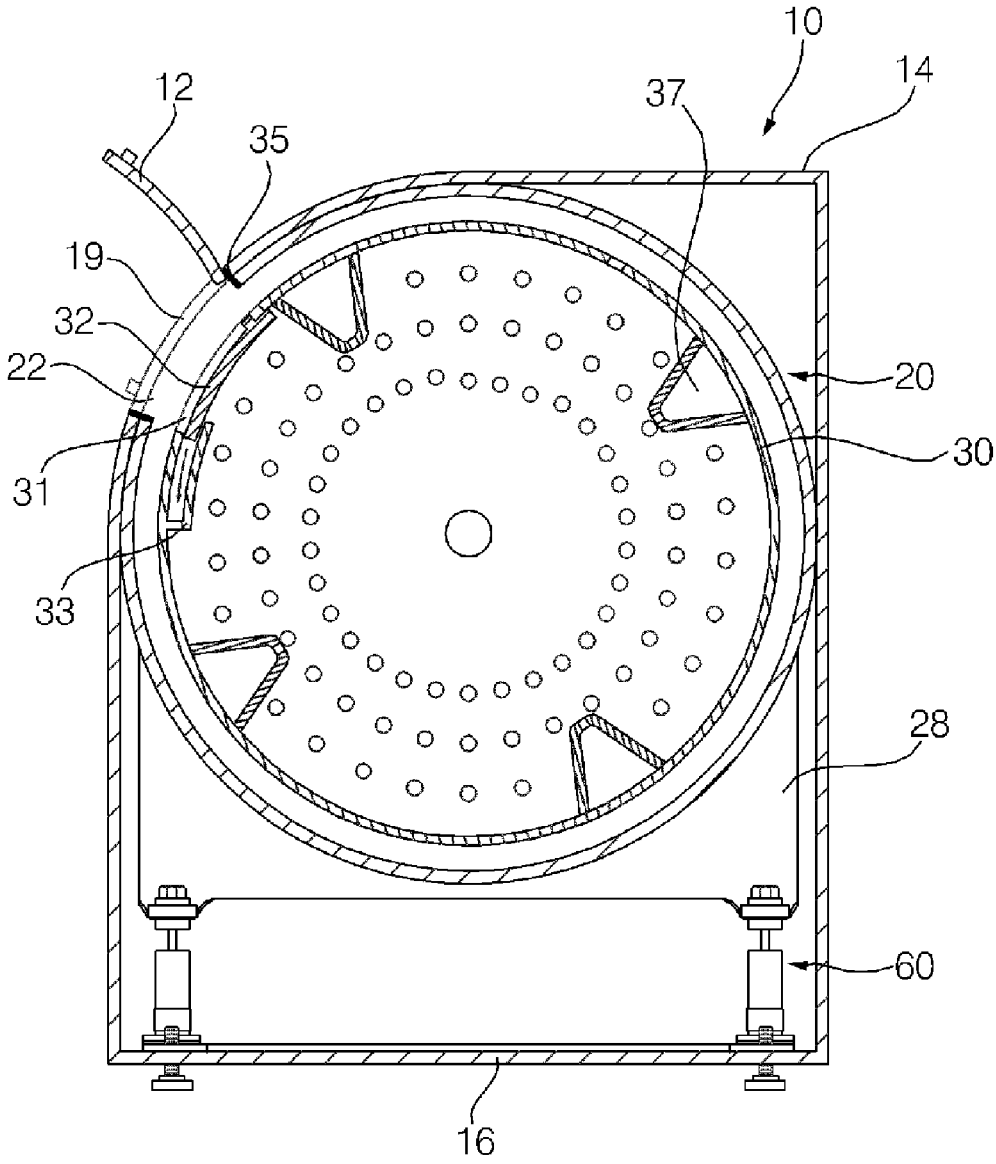

TOP-LOADING DRUM TYPE WASHING MACHINE

TECHNICAL FIELD

The present invention relates to a top-loading drum type washing machine, and more particularly, to a top-loading drum type washing machine in which a tub is integrated with a cabinet of the same size, thereby increasing capacities of a drum housing laundry and the tub.

BACKGROUND ART

FIG. 1 is a cross-sectional view illustrating an internal structure of a conventional drum type washing machine, and FIG. 2 is a cross-sectional view taken along a line II-II of FIG. 1.

As shown in FIG. 1 or 2, the conventional drum type washing machine includes a cabinet 1 having a base 1*a* and a door 1*b*; a tub 2 provided and fixed inside the cabinet 1; a drum 3 rotatably installed inside the tub 2 and rotating laundry (m) and washing water by a lift 3*a*; a motor 4 for rotating the drum 3; and a spring 5, a damper 6, and a balancer 7 for reducing vibration transmitted to the tub 2.

The drum 3 has a plurality of through-holes 3*b* for introducing the washing water stored in the tub 2, inside the drum 3. The lift 3*a* is provided at an inner side surface of the drum 3. The lift 3*a* rotating together with the drum 3 moves the laundry (m) loaded inside the drum 3, together with the washing water.

The tub 2 is spaced apart from an inner side surface of the cabinet 1. Both upper ends of the tub 2 are connected by the spring 5 and are locked inside the cabinet 1. The damper 6 is hinged and connected to the tub 2 and the base 1*a*, and is supported by an upper surface of the base 1*a*. The spring 5 and the damper 6 offset the vibration transmitted from the tub 2 to the cabinet 1.

A door 1*b* of the cabinet 1 is rotatably provided in front to input the laundry (m). Openings 2*c* and 3*c* are provided on front surfaces 2*d* and 3*d* of the tub 2 and the drum 3, respectively, to communicate with a through-hole (not shown) opened by the door 1*b*.

A gasket 8 is installed between a front surface 1*d* of the cabinet 1 having the door 1*b* and a front surface 2*d* of the tub 2 to prevent a leakage of the washing water. The gasket 8 makes airtight a space between an inner surface of the cabinet 1 and the front surface 2*d* of the tub 2.

The motor 4 is provided on a rear surface of the tub 2, and rotates the drum 3 provided inside the tub 2.

The balancer 7 balancing the rotating drum 3 is installed at the drum 3. The balancer 7 having a predetermined weight provides centrifugal force to the drum rotating at a high speed at the time of drying, and suppresses the vibration of the drum 3.

However, the above-described conventional drum type washing machine has a drawback in that the cabinet 1 is excessively large in volume compared to a capacity of the drum 3 where washing is substantially performed.

In other words, there is a drawback in that since the tub installed inside the cabinet 1 are spaced apart at its front surface (a) and both side surfaces (b) from the cabinet 1, the drum 3 is reduced in volume when the cabinet 1 is constant in size.

The above-described conventional drum type washing machine has a drawback in that since the bearing supporting a rotating drum shaft is provided only in rear of the drum, a load applied to the bearing relatively increases, thereby deteriorating the bearing in durability.

DISCLOSURE

Technical Problem

Accordingly, the present invention is to solve at least the problems and disadvantages of the background art.

The present invention is to provide a top-loading drum type washing machine for maximizing a capacity of a washing drum in a cabinet of the same size.

Technical Solution

To achieve these and other advantages and in accordance with the purpose of the present invention, as embodied and broadly described, there is provided a top-loading drum type washing machine. The washing machine includes a cabinet having an opening through which laundry comes in and out; a tub installed at the cabinet and having an opening through which the laundry comes in and out; a drum positioned inside the tub and having an opening through which the laundry comes in and out; a door provided at the drum, and opening and closing the opening of the drum; a motor for rotating the drum; a side assembly for supporting a pivot of the drum; a buffer unit connected between the side assembly and the tub; and a suspension connected between the side assembly and the cabinet.

The side assembly, the buffer unit, and the suspension may be provided at both sides of the drum, respectively.

The cabinet may have a door for opening and closing its opening.

The tub may be adhered and fixed at least one side surface thereof to an inner surface of the cabinet.

The tub may be adhered and fixed at a part of an upper and outer circumference surface thereof to an upper and inner surface of the cabinet, and the opening of the cabinet and the opening of the tub are provided at the adhered part.

The tub may include a tub body disposing the drum inside thereof and opened at its side surfaces; and a tub cover assembled to each of both side surfaces of the tub body and having the opening.

The side assembly may include a tub bracket through which the pivot of the drum passes; and a bearing housing assembled to a side surface of the tub bracket, allowing a passage of the pivot of the drum, and supporting the pivot.

The buffer unit is installed between the tub bracket and the tub cover.

The motor is installed at an outer side surface of the bearing housing, and further comprising a sub bearing housing supporting the motor and fixed to the bearing housing The suspension is installed between the bearing housing and the cabinet.

The washing machine may further include a sealing unit provided between the opening of the cabinet and the opening of the tub.

The sealing unit may be formed of rubber.

A liquid balancer for keeping a balance of the rotating drum may be provided at the drum.

Advantageous Effects

A top-loading drum type washing machine according to the present invention has an effect in that a tub is directly installed at a cabinet, thereby allowing a design of the drum with a maximal volume within the cabinet of a predetermined size.

The top-loading drum type washing machine according to the present invention has an effect in that a door is provided at the drum to open and close an opening of the drum, thereby preventing laundry inside the drum from being escaped through the opening of the drum.

The top-loading drum type washing machine according to the present invention has an effect in that the door opens and closes the opening of the drum in a sliding manner, thereby getting larger a capacity of the drum than when the door opens and closes the opening of the drum in a rotating manner.

The top-loading drum type washing machine according to the present invention has an effect in that the opening of the tub and the opening of the cabinet are communicated in succession and are sealed, thereby making it unnecessary to employ a conventional gasket used to connect the cabinet with the tub.

The top-loading drum type washing machine according to the present invention has an effect in that the tub is integrally assembled with the cabinet and its rigidity increases, thereby making lightweight a balancer suppressing a vibration of the drum at the time of drying.

The top-loading drum type washing machine according to the present invention has an effect in that a bearing supporting a pivot of the drum is positioned at each of both side surfaces of the tub to reduce a load and a moment applied to each bearing and minimize a repulsive force of the bearing, thereby increasing a durability of the top-loading drum type washing machine.

DESCRIPTION OF DRAWINGS

The invention will be described in detail with reference to the following drawings in which like numerals refer to like elements.

FIG. 1 is a cross-sectional view illustrating an internal structure of a conventional drum type washing machine;

FIG. 2 is a cross-sectional view taken along a line II-II of FIG. 1;

FIG. 3 is a partial cutaway perspective view illustrating an internal structure of a top-loading drum type washing machine according to the present invention;

FIG. 4 is a development perspective view illustrating main parts of a top-loading drum type washing machine according to the present invention;

FIG. 5 is a front cross-sectional view illustrating a top-loading drum type washing machine according to the present invention; and FIG. 6 is a side cross-sectional view illustrating a top-loading drum type washing machine according to the present invention.

BEST MODE

Preferred embodiments of the present invention will be described in a more detailed manner with reference to the drawings.

FIG. 3 is a partial cutaway perspective view illustrating an internal structure of a top-loading drum type washing machine according to the present invention, FIG. 4 is a development perspective view illustrating main parts of the top-loading drum type washing machine according to the present invention, FIG. 5 is a front cross-sectional view illustrating the top-loading drum type washing machine according to the present invention, and FIG. 6 is a side cross-sectional view illustrating the top-loading drum type washing machine according to the present invention.

As shown in FIGS. 3 to 6, the top-loading drum type washing machine according to the present invention includes a cabinet 10 forming an exterior shape; a tub 20 directly installed at the cabinet 10 to maximize an internal capacity of a drum 30; the drum 30 positioned and performing a wash within the tub 20; a motor 41 having a rotor 40 and a stator 40', installed at one side of the tub 20 and rotating the drum 30; a side assembly 27 positioned at a side of the tub 20, and constituting a side surface of the tub 20 and at the same time, supporting a pivot of the drum 30; a buffer unit 50 connecting between the side assembly 27 and the tub 20, and sealing the tub 20 and at the same time, cutting off vibration transmitted from the side assembly 27 to the tub 20; and a suspension 60 connecting between the side assembly 27 and the cabinet 10, and reducing vibration and impact generated in rotational motion of the drum 30.

The side assembly 27, the buffer unit 50, and the suspension 60 are provided at both side surfaces of the drum 30 in a symmetric manner on the basis of the drum 30, respectively.

In the top-loading drum type washing machine, openings 19 and 22 are sequentially provided on an upper end of the cabinet 10 and an upper end of the tub 20 to comes in and out laundry at an upper side, and an opening 31 is provided at one side of the drum 30 and up/down communicates with the openings 19 and 22 of the cabinet 10 and the tub 20.

The drum 30 should necessarily have a door 32 for preventing the laundry inside the drum from being escaped to a space between the tub 20 and the drum 30.

As sliding along a door guide 33 provided on an inner circumference surface of the drum 30, the door 32 of the drum 30 opens and closes the opening 31.

The door 32 of the drum 30 can be opened and closed in a sliding manner directly by a user. Of course, a separate door driving unit (not shown) can be provided such that it opens and closes the door in the sliding manner.

It is desirable that the cabinet 10 includes a door 12 provided at the opening 19 to protect the user of the top-loading drum type washing machine in the rotation of the drum 30.

The door 12 of the cabinet 10 is fixed to a hinge provided at one side of the opening 19. While rotating, the door 12 opens and closes the opening 19.

The tub 20 can include a door for stopping spattering washing water outside from the tub 20 through the opening 22. However, a sealing unit 35 is provided in an exemplary embodiment of the present invention and thus, the door covering the opening 22 of the tub 20 is not separately required.

In other words, the sealing unit 35 for sealing between the opening 19 of the cabinet and the opening 22 of the tub 20 is provided so as to seal an inner part of the tub 20 and prevent the washing water inside the drum 20 from being spattered outside through the opening 22. It is more effective that the sealing unit 35 is formed of rubber as the rubber can perform a buffer function.

The cabinet 10 has a top cover 14 with the opening 19 on its top surface 13, and has a base 16 fixing the suspension 60, that is, the damper on its bottom surface 15. The top and bottom surfaces 13 and 15 constitute the external shape of the top-loading drum type washing machine, together with a front surface 11, a side surface 18, and a rear surface 17.

The tub 20 includes a tub body 21 with the opening 22, opened at its both sides to communicate with the opening 19 of the top cover 14, and connecting directly to an inner side of the top surface 13 of the cabinet 10; a tub cover 24 having an opening 23 at its center, and connecting to each of the both side surfaces of the tub body 21 to cover the drum 30; a tub bracket 26 for closing the opening 23 of the tub cover 24; and a bearing housing 28 positioned at an outer side surface of the tub bracket 26, and supporting a drum shaft 42.

The side assembly includes the tub bracket 26 and the bearing housing 28, and makes the tub cover 24 airtight together with the buffer unit 50.

In the tub body 22, the tub 20 is adhered and fixed at its part of an upper and outer circumference surface to an upper and inner surface of the cabinet 10, and the openings 19 and 22 of the cabinet and the tub are provided at the adhered part of the cabinet and the tub. The opening 23 of the tub cover 24 is made airtight by the buffer unit 50 and the side assembly 27. The bearing housing 28 is assembled to an outer surface of the tub bracket 26 by a screw 25. The bearing housing 28 includes a bearing (not shown) to smoothly rotate the drum shaft 42. The drum shaft 42 is supported by the bearing.

The buffer unit 50 is to buffer the vibration or impact that is generated from the drum 30 and the motor 41 and is transmitted to the tub body 22 at the time of washing and drying. The buffer unit 50 is formed of elastic material that shrinks and relaxes depending on the vibration or impact. The buffer unit 50, a side gasket 50, is provided along an outer circumference of the tub bracket 26 to seal the opening 23 of the tub cover 24.

The motor 41 is installed at an outer surface of any one side of the bearing housings 28 provided at both sides of the tub body 22. A sub bearing housing 29 having a bearing (not shown) to smoothly rotate the drum shaft 42 connecting with the motor 41 is fixed to an outer surface of the bearing housing 28.

The drum 30 is rotated by the drum shaft 42. A plurality of lifters 37 for moving the laundry are provided on an inner surface of the drum 30.

Balancers 34 are provided at both side surfaces of the drum 30. The balancers 34 perform a balancing function of suppressing the vibration of the drum 30 caused by the one-sideness of the laundry at the time of drying. Specifically, when the vibration or impact is transmitted to the tub body 22 integrally assembled to the cabinet 10, the tub body 22 itself is not only vibrated but also, due to the addition of a self weight of the cabinet 10, the tub 20 increases in rigidity. Thus, the balancer 34 can employ even a balancer of small weight.

The suspension 60 is constituted of the damper. The damper 60 is positioned between the bearing housing 28 of the side assembly 27 and the base 16 of the cabinet 10, and is fixed to a damper bracket 61 connecting to each of the bearing housing 28 and the base 16. The damper 60 is provided by two at each bearing housing 28. As a result, the top-loading drum type washing machine according to an exemplary embodiment of the present invention has four dampers 60.

An operation of the top-loading drum type washing machine will be described below.

First, when the door 12 of the cabinet 10 is lifted up, the opening 19 of the cabinet 10 and the opening 22 of the tub 20 are opened up/down.

When the door 32 of the drum 30 is slid and moved in the direction of opening the opening 31, the opening 31 of the drum 30 up/down communicates with the opening 19 of the cabinet 10 and the opening 22 of the tub 20. When the user inputs the laundry through the opening 19 of the cabinet 10, the laundry is put in the drum 30 through the opening 19 of the cabinet 10, the opening of the tub 20, and the opening 31 of the drum 30.

After that, when the door 32 of the drum 30 is slid in the direction opposite to when the opening 31 of the drum 30 is opened, the door 32 of the door 30 makes the opening 31 of the drum 30 airtight. When the door 12 of the cabinet 10 is shut down, the door 12 of the cabinet 10 makes the opening 19 of the cabinet 10 airtight.

In the top-loading drum type washing machine, the laundry is housed, the washing water is supplied, and the motor 41 is driven, thereby executing a washing stroke.

When the motor 41 is driven, the drum shaft 42 rotates while supported by the bearing housing 28 and the sub bearing housing 29, and rotates the drum 30. The drum 30 rotates together with the door 32, washing the laundry.

Meantime, in the top-loading drum type washing machine, when the drum 30 rotates as above, it causes the vibration. The vibration is transmitted to the suspension 60 through the bearing housing 28 and the tub bracket 26, and is buffered by the suspension 60.

As above, after the execution of the washing stroke, the top-loading drum type washing machine executes a rinse stroke or a dry stroke. Upon the completion of all strokes of the top-loading drum type washing machine, the motor 41 stops rotating the drum 30 such that the opening 31 of the drum 30 is positioned under the opening 19 of the cabinet 10 and the opening of the tub 20.

After that, if the door 12 of the cabinet 10 is lifted up, the opening 19 of the cabinet 10 and the opening 22 of the tub 20 are opened up/down.

If the door 32 of the drum 30 is again slid and moved in the direction of opening the opening 31, the opening 31 of the drum 30 up/down communicates with the opening 19 of the cabinet 10 and the opening 22 of the tub 20. When the user puts his/her hand or a plier in and puts the laundry out the opening 19 of the cabinet 10, the opening 22 of the tub 20, and the opening 31 of the drum 30, the laundry inside the drum 30 is taken outside the top-loading drum type washing machine through the opening 31 of the drum 30, the opening 22 of the tub 20, and the opening 19 of the cabinet 10, sequentially.

INDUSTRIAL APPLICABILITY

The above constructed and operating top-loading drum type washing machine according to the present invention has an advantage in that a tub is directly installed at a cabinet, thereby allowing a design of the drum with a maximal volume within the cabinet of a predetermined size.

The top-loading drum type washing machine according to the present invention has an advantage in that a door is provided at the drum to open and close an opening of the drum, thereby preventing laundry inside the drum from being escaped through the opening of the drum.

The top-loading drum type washing machine according to the present invention has an advantage in that the door opens and closes the opening of the drum in a sliding manner, thereby getting larger a capacity of the drum than when the door opens and closes the opening of the drum in a rotating manner.

The top-loading drum type washing machine according to the present invention has an advantage in that the opening of the tub and the opening of the cabinet are communicated in succession and are sealed, thereby making it unnecessary to employ a conventional gasket used to connect the cabinet with the tub.

The top-loading drum type washing machine according to the present invention has an advantage in that the tub is integrally assembled with the cabinet and its rigidity increases, thereby making lightweight a balancer suppressing a vibration of the drum at the time of drying.

The top-loading drum type washing machine according to the present invention has an advantage in that a bearing supporting a pivot of the drum is positioned at each of both side surfaces of the tub to reduce a load and a moment applied to each bearing and minimize a repulsive force of the bearing, thereby increasing a durability of the top-loading drum type washing machine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A top-loading drum type washing machine, comprising:

a cabinet having a first opening formed therein;

a tub provided in the cabinet and having a second opening formed in a peripheral wall thereof, wherein a portion of the tub is attached to a corresponding portion of the cabinet and the first opening and the second opening are respectively formed at the attached portions of the cabinet and the tub such that the attached portions surround the first and second openings;

a drum provided in the tub and having a third opening formed at a peripheral wall thereof such that laundry is loaded into and removed from the drum through the first, second and third openings;

a first door that opens and closes the first and second openings together;

a second door provided at the drum, wherein the second door opens and closes the third opening;

a motor for rotating the drum;

a first side assembly provided at a first axial end wall of the drum, comprising:

a substantially annular first bracket having a first side thereof facing the first axial end wall of the drum, wherein a shaft of the drum passes through the first bracket; and a first bearing housing attached to a second side of the first bracket opposite the side thereof such that the first bracket is positioned between the first bearing housing and the first axial end wall of the drum, wherein the shaft of the drum passes through and is supported by the first bearing housing;

a second side assembly provided at a second axial end wall of the drum opposite the first axial end wall, comprising:

a substantially annular second bracket coupled to the second axial end wall of the tub; and a second bearing housing coupled to the second bracket to support rotation of the drum by the motor coupled to the first side assembly;

a first suspension directly connected between the first side assembly and the cabinet, the first suspension elastically supporting the drum, the first side assembly, and the motor; and a second suspension directly connected between the second side assembly and the cabinet, the second suspension supporting the second side assembly and the second axial end of the drum.

2. The washing machine of claim 1, wherein an upper outer circumferential portion of the tub is adhered and fixed to an upper portion of the cabinet such that the adhered portions of the tub and the cabinet surround the first and second openings.

3. The washing machine of claim 1, wherein the tub comprises:

a tub body in which the drum is received, the tub body having first and second opened end surfaces; and first and second tub covers respectively coupled to the first and second opened end surfaces of the tub body.

4. The washing machine of claim 3, further comprising a first buffer unit which is installed between the first bracket and the tub cover.

5. The washing machine of claim 3, wherein the motor is installed at an outer side surface of the first bearing housing opposite a side thereof facing the first bracket, and further comprising a sub bearing housing supporting the motor and fixed to the first bearing housing.

6. The washing machine of claim 1, wherein the first suspension is installed between the first bearing housing and the cabinet and the second suspension is installed between the second bearing housing and the cabinet.

7. The washing machine of claim 1, further comprising a sealing device provided between the first opening of the cabinet and the second opening of the tub.

8. The washing machine of claim 7, wherein the sealing device is formed of rubber.

9. The washing machine of claim 1, further comprising a liquid balancer provided at the drum to maintain a balance of the rotating drum.

10. The washing machine of claim 1, further comprising a first buffer device connected between the first side assembly and the tub, wherein the first buffer device forms a seal between the first side assembly and the tub, and is configured to buffer vibration generated by the drum and the motor.

11. The washing machine of claim 1, wherein the cabinet comprises a curved surface in which the first opening is formed, and wherein the second opening is formed in a circumferential surface of the tub corresponding to the curved surface of the cabinet.

12. The washing machine of claim 1, wherein the first suspension comprises a plurality of first dampers which are provided between the first bearing housing and a side surface of the cabinet.

13. The washing machine of claim 12, wherein the plurality of first dampers are disposed vertically.

14. The washing machine of claim 12, wherein upper ends of the plurality of first dampers are positioned at locations which are radially further from a rotational axis of the drum than is a circumference of the tub.

15. The washing machine of claim 12, where the first suspension comprises a plurality of first dampers vertically connected between the first bearing housing and the cabinet, and the second suspension comprises a plurality of second dampers vertically connected between the second bearing housing and the cabinet.

16. The washing machine of claim 1, wherein a first side of the second bracket faces the drum and the second bearing housing is coupled to a second side of the second bracket, opposite the first side thereof, such that the second bracket is positioned between the second bearing housing and the second axial end wall of the drum.

17. The washing machine of claim 1, wherein the attached portions of the cabinet and the tub are directly attached, without any gap formed therebetween.

* * * * *